US011278080B2

(12) United States Patent
Ransan

(10) Patent No.: US 11,278,080 B2
(45) Date of Patent: Mar. 22, 2022

(54) BALLET POINTE SHOE HAVING TOE PLATFORM WITH MALLEABLE BUMPER

(71) Applicant: Lisias Ransan, Boca Raton, FL (US)

(72) Inventor: Lisias Ransan, Boca Raton, FL (US)

( * ) Notice: Subject to any disclaimer, the term of this patent is extended or adjusted under 35 U.S.C. 154(b) by 112 days.

(21) Appl. No.: 16/701,652

(22) Filed: Dec. 3, 2019

(65) Prior Publication Data

US 2020/0229533 A1 Jul. 23, 2020

Related U.S. Application Data

(63) Continuation-in-part of application No. PCT/US2019/058206, filed on Oct. 25, 2019.

(60) Provisional application No. 62/925,729, filed on Oct. 24, 2019, provisional application No. 62/794,589, filed on Jan. 19, 2019.

(51) Int. Cl.
*A43B 5/12* (2006.01)
*A43B 1/14* (2006.01)

(52) U.S. Cl.
CPC . *A43B 5/12* (2013.01); *A43B 1/14* (2013.01)

(58) Field of Classification Search
CPC ..... A43B 5/12; A43B 1/14
USPC ..... 36/8.3
See application file for complete search history.

(56) References Cited

U.S. PATENT DOCUMENTS 1,621,455 A 3/1927 Bonaventure
1,689,535 A 10/1928 Rovik
1,927,211 A 9/1933 Harris
1,934,591 A 11/1933 Churchill et al.
2,118,835 A 5/1938 Capezio
2,487,247 A * 11/1949 Kenny ..... A43B 5/12 36/8.3
3,191,321 A 6/1965 Brutting
3,257,743 A * 6/1966 Closson, Jr. ..... A43B 23/16 36/68
3,435,544 A 4/1969 Lish
4,026,046 A 5/1977 Clark et al.
4,133,117 A 1/1979 Bradley
4,162,583 A 7/1979 Darrin
4,199,878 A 4/1980 Wossner
4,453,996 A 6/1984 Terlizzi, Jr. et al.
4,598,485 A 7/1986 Joe et al.
4,656,761 A 4/1987 Lord
4,735,003 A 4/1988 Dykeman
RE33,018 E 8/1989 Ostrander
(Continued)

FOREIGN PATENT DOCUMENTS

CN 106820415 A 6/1997
RU 2003134643 A 12/2004
(Continued)

*Primary Examiner* — Ted Kavanaugh
(74) *Attorney, Agent, or Firm* — Donald S. Showalter, Esq.; GrayRobinson, P.A.

(57) ABSTRACT

A ballet pointe shoe may include a toe box with a malleable bumper attached to a bottom portion of a front wall of the toe box. In some embodiments, the toe box may be part of a monolithic foot-supporting structure which may also include a shank body extending longitudinally rearward from a base of the toe box. In some embodiments, the shank may be penetrated by a longitudinal tunnel which has a mouth on the shank body and some embodiments may include a removable shank insert which can be inserted into the tunnel by way of the mouth and removed from the tunnel by way of the mouth.

6 Claims, 8 Drawing Sheets

(56) References Cited

U.S. PATENT DOCUMENTS

| | | | | |
|---|---|---|---|---|
| 4,901,453 | A * | 2/1990 | Gaynor | A43B 5/12 36/113 |
| 5,035,069 | A * | 7/1991 | Minden | A43B 5/12 36/113 |
| 5,129,165 | A | 7/1992 | Woodie | |
| 5,191,726 | A | 3/1993 | Vallee | |
| 5,220,735 | A * | 6/1993 | Raoul-Duval | A43B 5/12 36/108 |
| 5,331,751 | A | 7/1994 | Harwood | |
| 5,469,641 | A | 11/1995 | Subotic | |
| D388,592 | S | 1/1998 | Minden | |
| 5,740,618 | A | 4/1998 | Minden | |
| 6,705,026 | B1 | 3/2004 | Arbour | |
| 6,711,833 | B1 * | 3/2004 | Ransan | A43B 5/12 36/8.3 |
| 6,810,603 | B1 | 11/2004 | Cosentino | |
| 6,857,203 | B2 | 2/2005 | Minden | |
| 6,895,693 | B2 | 5/2005 | Baruck | |
| 6,928,755 | B2 | 8/2005 | Chen et al. | |
| 7,096,605 | B1 | 8/2006 | Kozo et al. | |
| 7,124,519 | B2 | 10/2006 | Issler | |
| D535,461 | S | 1/2007 | Wilkenfeld et al. | |
| 7,254,904 | B2 | 8/2007 | Nye | |
| D559,504 | S | 1/2008 | Wilkenfeld et al. | |
| D591,487 | S | 5/2009 | Comeau | |
| 7,707,673 | B2 | 5/2010 | Durbin | |
| 7,765,718 | B2 | 8/2010 | Wilkenfeld | |
| D630,829 | S | 1/2011 | Weisner | |
| 7,900,375 | B2 | 3/2011 | Thoraval | |
| 7,926,203 | B2 | 4/2011 | Wilkenfeld | |
| 8,186,080 | B2 | 5/2012 | Favreau et al. | |
| 8,191,285 | B2 | 6/2012 | Perron, Jr. | |
| 8,479,416 | B2 | 7/2013 | Auger et al. | |
| D707,927 | S | 7/2014 | Nataadiningrat et al. | |
| D730,025 | S | 5/2015 | Minden | |
| 9,314,068 | B2 | 4/2016 | Schmutte | |
| 9,414,639 | B2 | 8/2016 | Heathcote | |
| 9,491,981 | B2 | 11/2016 | Suffolk et al. | |
| D781,032 | S | 3/2017 | Gavrieli et al. | |
| D781,035 | S | 3/2017 | Gavrieli et al. | |
| D812,864 | S | 3/2018 | Abramowitz | |
| D841,973 | S | 5/2019 | Small | |
| 2002/0014023 | A1 | 2/2002 | Tolwin et al. | |
| 2002/0108270 | A1 | 8/2002 | Williams | |
| 2004/0093761 | A1 * | 5/2004 | Nye | A43B 23/08 36/8.3 |
| 2004/0226191 | A1 | 11/2004 | Hsieh | |
| 2005/0022421 | A1 | 2/2005 | Bruckner | |
| 2007/0199208 | A1 * | 8/2007 | Wilkenfeld | A43B 5/12 36/8.3 |
| 2008/0034612 | A1 | 2/2008 | Palattella | |
| 2008/0209761 | A1 | 9/2008 | Thorcal | |
| 2009/0151200 | A1 | 6/2009 | Niedermeyer et al. | |
| 2009/0272009 | A1 | 11/2009 | Weisner et al. | |
| 2010/0126042 | A1 | 5/2010 | Wyon | |
| 2010/0146822 | A1 | 6/2010 | MacGregor | |
| 2010/0281715 | A1 | 11/2010 | Cayol et al. | |
| 2014/0033569 | A1 | 2/2014 | Davis | |
| 2014/0259774 | A1 | 9/2014 | Minden | |
| 2015/0007454 | A1 | 1/2015 | Swift | |
| 2015/0173454 | A1 | 6/2015 | Perez et al. | |
| 2015/0342293 | A1 | 12/2015 | Hazzouri | |
| 2017/0215519 | A1 | 8/2017 | McHugh | |

FOREIGN PATENT DOCUMENTS

| | | | |
|---|---|---|---|
| WO | 2002087374 | A1 | 11/2002 |
| WO | 2007029964 | A1 | 3/2007 |

* cited by examiner

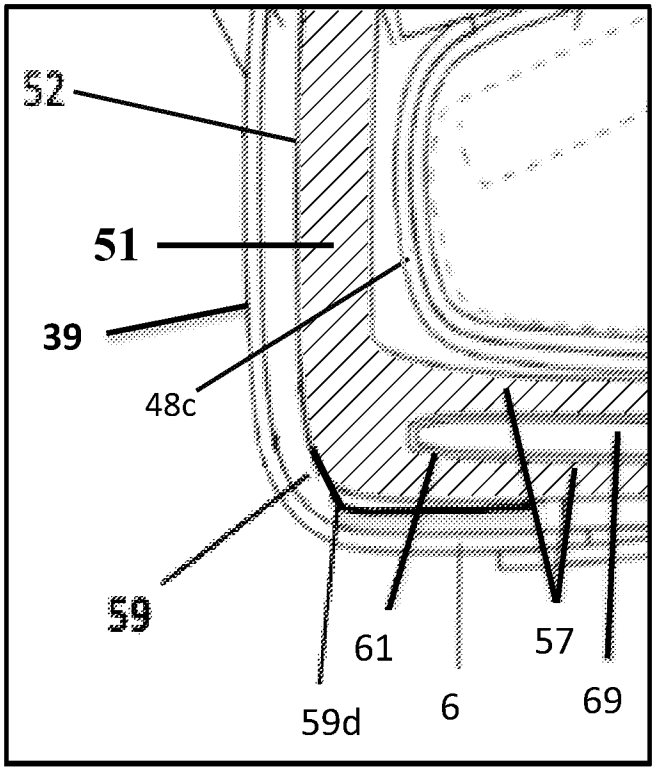
FIG. 4A2
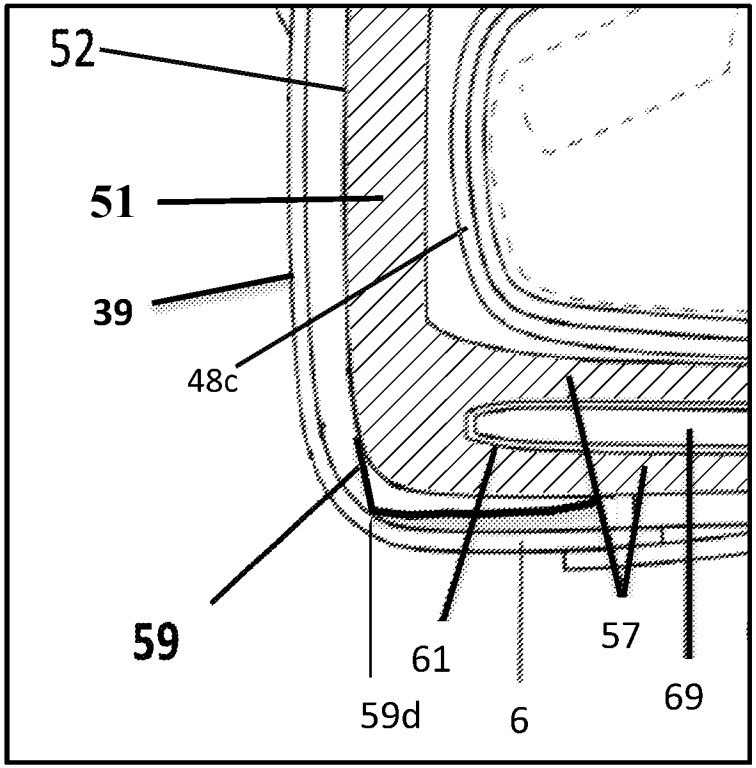
FIG. 4A1

BALLET POINTE SHOE HAVING TOE PLATFORM WITH MALLEABLE BUMPER

CROSS-REFERENCE TO RELATED APPLICATIONS

This is a continuation-in-part of co-pending, commonly owned Application No. PCT/US2019/58206 entitled: BALLET POINT SHOE which was filed on Oct. 25, 2019 and which designated the U.S. and at least one other country in addition to the U.S. and to which priority is hereby claimed under 35 U.S.C. § 120. Priority under 35 U.S.C. § 119(e) is hereby claimed to each of the following U.S. provisional patent applications for all subject matter in each commonly disclosed herein: U.S. Provisional Patent Application No. 62/794,589 entitled "Ballet Pointe Shoe" filed Jan. 19, 2019, and U.S. Provisional Patent Application No. 62/925,729 entitled "Ballet Pointe Shoe" filed Oct. 24, 2019, both of which are commonly owned with the present application.

STATEMENT REGARDING FEDERALLY-SPONSORED RESEARCH OR DEVELOPMENT

Not applicable.

INCORPORATION BY REFERENCE

International Application No. PCT/US2019/58206 entitled: BALLET POINT SHOE which was filed on Oct. 25, 2019, U.S. Provisional Patent Application No. 62/794,589 entitled "Ballet Pointe Shoe" filed Jan. 19, 2019, and U.S. Provisional Patent Application No. 62/925,729 entitled "Ballet Pointe Shoe" filed Oct. 24, 2019 are each expressly incorporated herein by reference in their entireties to form part of the present disclosure

FIELD OF THE INVENTION

The invention relates to the field of pointe shoes for ballet dancing. More particularly, the invention relates to ballet pointe shoes which may incorporate a thermoplastic toe box with a toe box having a malleable bumper.

BACKGROUND OF THE INVENTION

The art of ballet dancing is a synthesis of grace, poise and fluidity of motion of the human form. Its mastery requires not only disciplined training but also considerable bodily strength, endurance and athleticism. Albert Einstein once described dancers as "the athletes of God". The physical demands ballet imposes on a performer make it imperative that ballet pointe shoes, fit the dancer very well and provide appropriate support of the foot. Appropriate support is especially important in critical areas of the foot such as the toes, the metatarsal region and arch. Good fit and appropriate support not only afford better comfort but also to reduce fatigue and the risk of injury or other maladies which may result from improper form, muscle fatigue, muscle strain, falling or other maladies, all of which can be caused or exacerbated by ill-fitting or improperly supportive ballet pointe shoes. Maladies which commonly afflict ballet dancers include pulled or torn muscles and ligaments, joint damage, sprains and conditions as tendonitis, posterior impingement, flexor hallucis longus tenosynovitis (a/k/a "trigger toe"), posterior compartment syndrome, achilles tendinopathy, plantar fasciitis and osteoarthritis. All can be painful and may require expensive medical treatment and/or temporary or permanent limitation or cessation of dancing or other physical activities. Some may even end the career of a ballet performer.

In a ballet pointe shoe, the forefoot support provided by the toe box of the shoe and appropriate support of the arch region are always important but especially so when a dancer enters and maintains certain positions or performs certain movements such as eleve´ or releve´ in which a dancer is supported on the stage or other dance floor on their toes and the heel of the foot is elevated above the stage or dance floor. The elevation of the heel is increased further when a dancer assumes a "demi-pointe" and further yet when fully "en pointe" where the dancer is supported on the very tips of the toes. In such movements, the toe box of a ballet pointe shoe may bear substantially all of the weight the dancer. A ballet pointe shoe, and especially its toe box may also be subjected to impact forces or other dynamic forces not only when the performer is in such extreme postures but also in the process of assuming or transitioning out of such postures.

A typical ballet pointe shoe has an upper having toe platform at its front end, a heel adjacent its rear end, a vamp, lateral sides extending between the heel and the vamp, and a throat extending between the vamp and the heel. An insole is typically disposed inside the upper at the bottom of the foot compartment and an outsole is typically secured beneath the upper. The throat is the top opening by way of which a foot of the ballet dancer enters the foot compartment upper when putting on the ballet pointe shoe for use. At least part of the exterior of the upper of a typical ballet pointe shoe has an outer fabric and some or all of the interior of the upper may be lined with an inner liner.

BRIEF SUMMARY OF CERTAIN EMBODIMENTS

In some embodiments, a ballet pointe shoe has an upper having a foot compartment which includes a toe box, the toe box having a base and a thermoplastic toe box which has a bottom portion and a top portion. The ballet pointe shoe further includes a malleable bumper formed on or attached to at least the bottom portion of the toe box. In some embodiments, at least a portion of the toe box is made of thermoplastic while the malleable bumper may be made of a non-elastic, non-resilient material. In some embodiments the malleable bumper can be made of a single layer of material while in other embodiments the malleable bumper can be made of at least one or more layers of material. In some embodiments, the malleable bumper can be formed of cellulose impregnated with latex such as the material known as Texon® 516 made by Texon Materials, Inc. of Westfield Mass. Texon® is a registered trademark of Texon Moeckmuehl GmbH. In some embodiments, at least a portion of the toe box is made of thermoplastic and the malleable bumper is made of at least one or more layers of cellulose impregnated with latex. In some embodiments each layer of the one or more layers of cellulose impregnated with latex each has a thickness ranging from 0.70 millimeters to 2 millimeters.

In some embodiments the malleable bumper is arranged and configured to be flush with a vertical wall portion of the toe box and in yet other embodiments the malleable bumper can extend beyond the vertical wall of the bottom portion of the toe box. In some embodiments, the toe box further includes a peripheral wall and the malleable bumper is arranged and configured to form on both the bottom portion of the toe box and a portion of the peripheral wall of the toe box. In some embodiments the toe box is made of thermoplastic, the malleable bumper is made of at least one or more layers of cellulose impregnated with latex, and where the toe box further includes a peripheral wall and the malleable bumper is arranged and configured to form on both the bottom portion of the toe box and a portion of the peripheral wall of the toe box.

In some embodiments, the malleable bumper is made of at least one or more layers of cellulose impregnated with latex and further formed on the bottom portion of the toe box using one or more of adhesive bonding, solvent bonding, thermal fusion bonding, ultrasonic welding, or stitching. In yet other embodiments, the platform and the malleable bumper are made using double-shot molding wherein the toe box is made of a plastic of a higher Shore durometer than the plastic used for the malleable bumper. In other embodiments, the toe box and the malleable bumper are made using thermoplastic for the toe box and further overmolding a second plastic over the toe box wherein the second plastic is of a lower Shore durometer than the thermoplastic and the second plastic is a non-elastic or a non-resilient material.

In some embodiments the ballet pointe shoe can include an upper in which the toe box is an integral part of a monolithic foot-supporting structure, where the monolithic foot-supporting structure includes a toe box and optional shank body, the toe box having a peripheral wall and a base adjoining the peripheral wall as part of a toe box, the-toe box including a bottom portion and a top portion. The ballet pointe shoe further includes a malleable bumper formed on or attached to the bottom portion of the toe box.

In some embodiments, the upper further includes a shank body having a tunnel which extends longitudinally through at least a portion of the shank body where the tunnel has a mouth disposed on the shank body and the mouth being accessible by way of the foot compartment without deconstructing the ballet pointe shoe even partially. In some arrangements, the ballet pointe shoe may further include a shank insert, at least a forward portion of the shank insert being removable and replaceably received in the tunnel when the shank insert is installed in the tunnel, the shank insert being removable from the ballet pointe shoe by withdrawing the forward portion of the shank insert from the tunnel by way of the mouth. In some arrangements, the shank insert is selected from a set of two or more of the shank inserts, at least one shank insert in the set having a first flexural rigidity profile, at least one other shank insert in the set having a second flexural rigidity profile which differs from the first flexural rigidity profile.

In some embodiments, the toe box is made of thermoplastic and the malleable bumper is made of a single layer of cellulose impregnated with latex. In other arrangements, the toe box is formed of a thermoplastic material and the malleable bumper is made of multiple layers of cellulose impregnated with latex enabling the malleable bumper to reshape over time from use.

In some embodiments, a ballet pointe shoe for use by a ballet dancer can include an upper which includes a monolithic foot-supporting structure made of thermoplastic, where the monolithic foot-supporting structure includes a toe box having a peripheral wall and a base adjoining the peripheral wall. The ballet pointe shoe further includes a malleable bumper formed on a portion of the base and on a portion of the peripheral wall. Some embodiments include an upper which incorporates a monolithic foot-supporting structure having a toe box and a shank body which extends longitudinally rearward from a base of the toe box. The toe box may have peripheral wall which adjoins its base such that the peripheral wall and base together form a cavity at the front of the foot compartment. The peripheral wall of the toe box may include a front wall having an outer surface which may be disposed behind the platform. The shank body and the base of the toe box underlie and support at least a portion of the sole of the foot of the ballet dancer. In some embodiments the sole of the foot of the ballet dancer, including the heel of the foot may be supported by way of an insole overlying the shank body and the base of the toe box.

Some embodiments include an optional shank insert installed in the ballet pointe shoe in a manually removable and replaceable manner. To accommodate a shank insert, at least a portion of the shank body of the monolithic foot-supporting structure may be penetrated by a tunnel which extends in a longitudinal direction and has an open mouth disposed on the shank body.

In some embodiments, the malleable bumper may be formed at least in part of a material which can be modified by heating or by pressure and semi-permanently reshaped at point of sale, point of use or other desired place or time in the course of the useful life of the pointe shoe to suit the needs of a particular use and/or preferences of a particular dancer. Reshaping a malleable bumper may be useful not only to alter its shape but may also modify its flexural rigidity profile. A malleable bumper may be one which has been reshaped by, for example, pressure or heating at least a portion of the malleable bumper to a temperature which is below the melting temperature of the malleable bumper material but is sufficient to cause at least the aforementioned portion of the malleable bumper to be in a softened state, applying a pressure to the malleable bumper when at least that portion of the malleable bumper is in the softened state to reshape the malleable bumper from the previous shape into and altered shape and lowering the temperature of at least said portion of the malleable bumper to a lower temperature at which the altered shape is retained semi-permanently until use of the ballet pointe shoe over time causes further reshaping of the malleable bumper. A malleable bumper may be one which has been reshaped on one or more prior occasions. For example, a malleable bumper which has been reshaped from a previous shape into an altered shape may, if desired, be reshaped at any time into a subsequent altered shape.

In some embodiments, in addition to reshaping the malleable bumper, at least a portion of the toe box of the monolithic foot-supporting structure may be formed of thermoplastic material and can be reshaped at any time from a previous shape into an altered shape which is different than the previous shape. Reshaping of the toe box may be carried out by, for example, heating at least that portion of the toe box to a temperature which is below the melting temperature of the thermoplastic but is sufficient to cause at least the aforementioned portion of the toe box to be in a softened state, applying a force to the toe box when at least that portion of the toe box is in the softened state to reshape the toe box from the previous shape into the altered shape and lowering the temperature of at least that portion of the toe box to a lower temperature at which the altered shape is retained permanently or semi-permanently even in the absence of the applied force. The shape of the interior cavity of the toe box, and thus, the fit of the ballet pointe shoe may thereby be adjusted or customized to suit the needs or preferences of a particular dancer. Moreover, such reshaping can be carried out once or repeatedly over the useful life of a pointe shoe as the needs of a particular application and/or foot size, foot shape and/or individual preference of a dancer may change from time to time.

These and other embodiments of the invention are described in further detail below with reference to the drawings in which like reference numerals designate like items. In the detailed description, reference is made to the drawings that are briefly described below wherein like reference numerals designate like items. The drawings show non-limiting illustrations of some embodiments that may be practiced within the scope of the claims. It is to be understood that other embodiments may be implemented and that various structural, procedural other changes may be made without departing from the scope of the invention.

BRIEF DESCRIPTION OF THE DRAWINGS

FIG. 4A is a first partial sectional view taken along line A-A of FIG. 2 with the foot of a ballet dancer and an optional elastic shown in phantom lines and FIGS. 4A1 and 4A2 are enlarged views of the dashed box area within FIG. 4A;

DETAILED DESCRIPTION OF PREFERRED EMBODIMENTS

Figure 1:
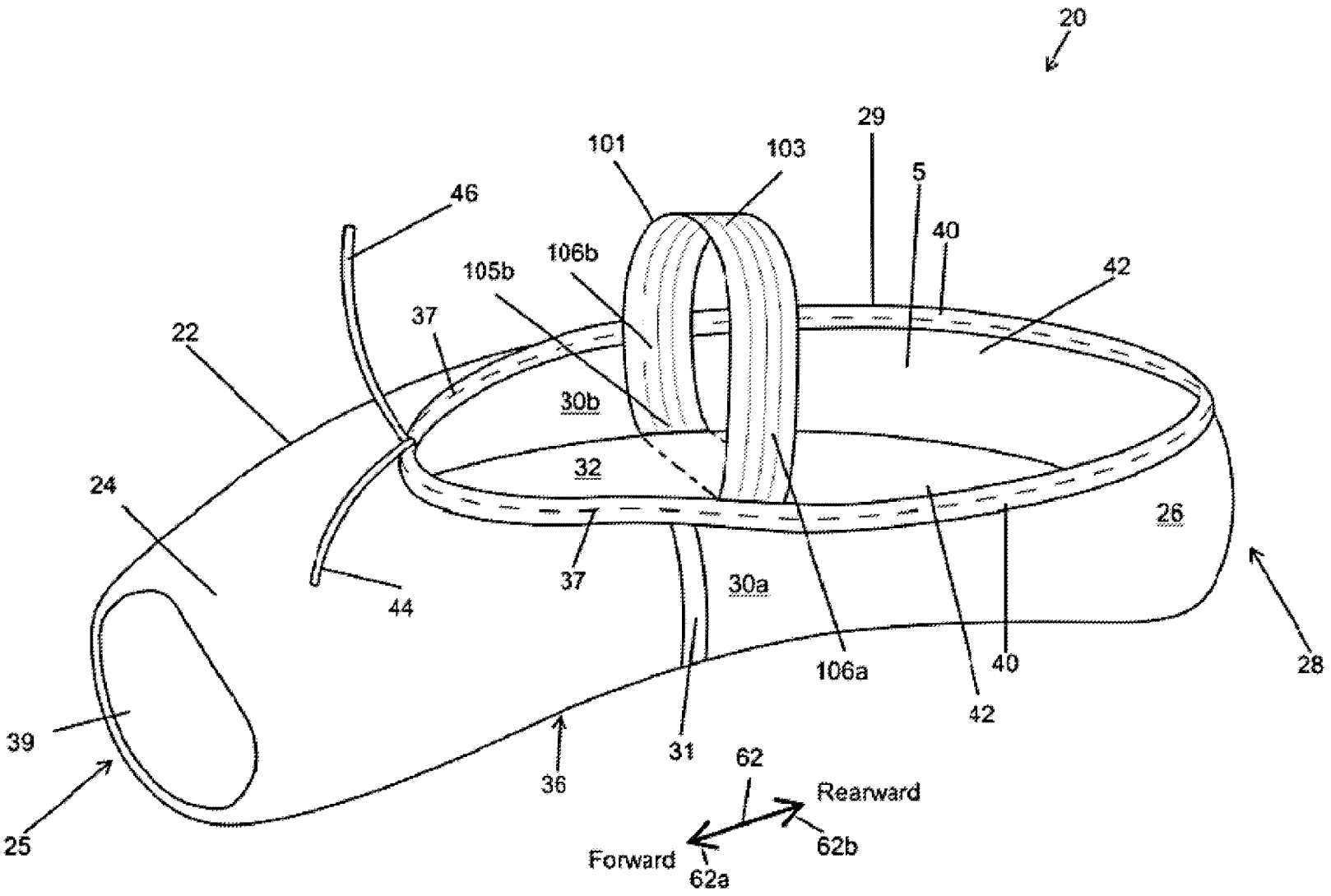
FIG. 1 is a perspective view of an embodiment of a ballet pointe shoe with an optional removable and replaceable elastic loop installed shown therein.

FIGS. 1, 2, 3, 4A and 4B show a non-limiting example of an embodiment of a ballet pointe shoe 20. For convenience, some aspects of an embodiment may be described herein with reference to an imaginary longitudinal axis 49 which may extend in a longitudinal direction 62. The imaginary longitudinal axis 49 may, but need not necessarily, represent an axis of symmetry of a ballet pointe shoe 20.

A ballet pointe shoe 20 may include an upper 22 having an outer fabric 6 and an inner liner 7. The upper 20 has a platform 39 at its front end 25, a heel 26 adjacent its rear end 28, a vamp 24, and lateral sides 30*a* and 30*b* extending in a longitudinal direction 62 between the vamp 24 and heel 26. The upper 22 has an open throat 27 by way of which a foot 41 of a ballet dancer enters the foot compartment 5 of the ballet pointe shoe 20. Some embodiments of a ballet pointe shoe 20 include an outsole 34 disposed beneath the upper 22 on the underside 36 of the ballet pointe shoe 20 and an insole 32 disposed within the foot compartment 5.

In some embodiments, the lateral sides 30*a* and 30*b* of the upper 22 may optionally include lateral seams 31*a* and 31*b*. The outer fabric 6 and/or inner liner 7 may optionally be joined at a heel seam 31*c* which, in some embodiments, may optionally include an external binding strip 33 attached to the heel 26. In some embodiments, all or at least a portion of the upper 22 is covered by an outer fabric 6 and all or at least a portion of the interior of the upper 22 is lined with an inner liner 7.

Figure 2:
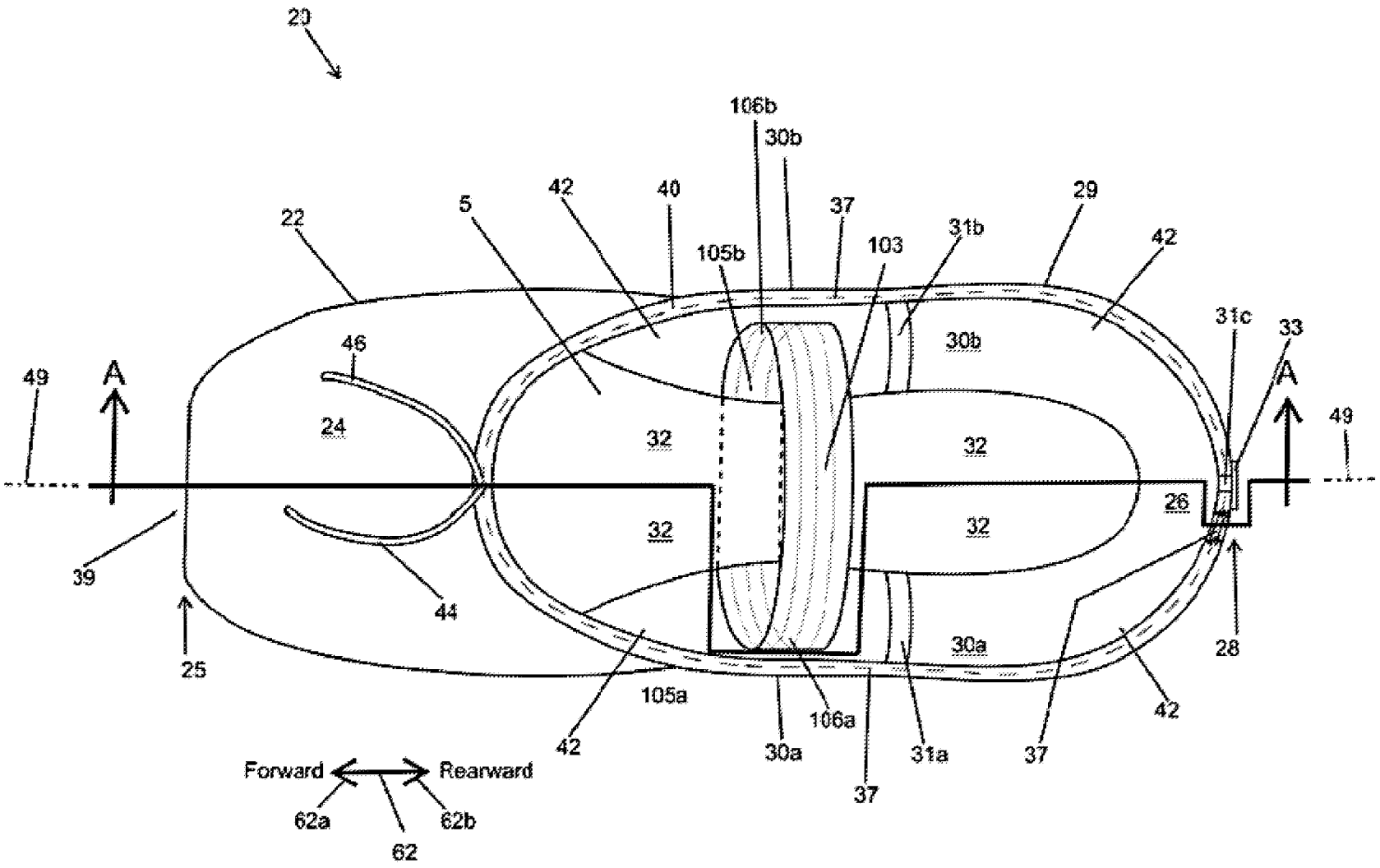
FIG. 2 is a top plan view of the embodiment of FIG. 1.
Figure 3:
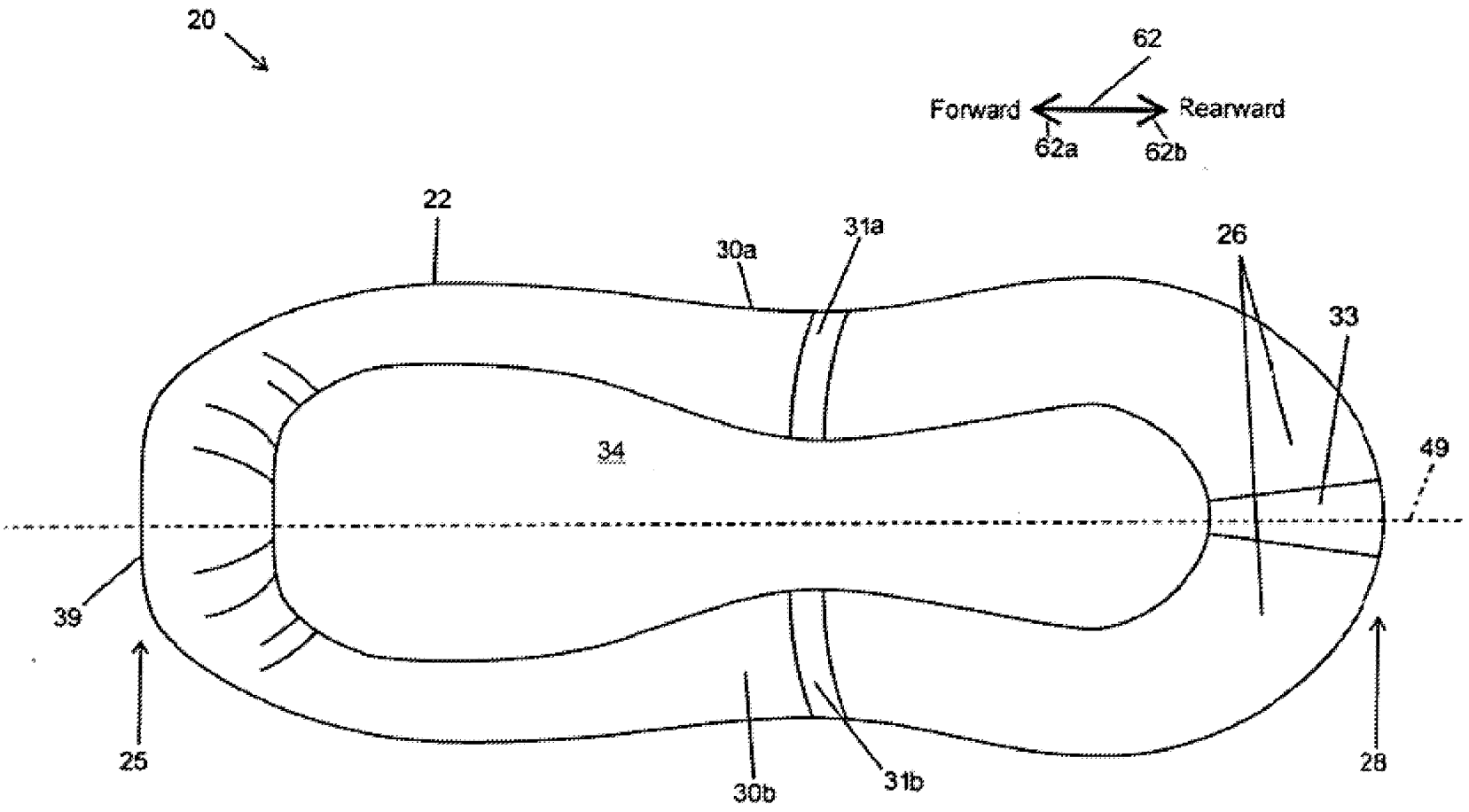
FIG. 3 is a bottom plan view of the embodiment of FIGS. 1 and 2.

In some embodiments, the outer fabric 6 and inner liner 7 may be joined to one another along a throat seam 29 which may run peripherally of the throat 27. In some embodiments, the throat seam 29 may optionally include an external binding strip 35 that may be folded lengthwise and sewn to the outer fabric 6 and/or inner liner 7 in a manner which forms a passage 40 inside the binding strip 35. To help secure the ballet pointe shoe to the foot 41 of a ballet dancer, some embodiments may optionally include a drawstring 37 surrounding the throat 27. In FIG. 2, a portion of the binding strip 35 of the throat seam 29 is shown partially cut away in the vicinity of the heel 26 to reveal the drawstring 37. The drawstring 37 may have free ends 44 and 46 extending from the passage 40 to permit the drawstring 37 to be cinched and tied or otherwise fastened to one another for use. The free ends 44 and 46 of the drawstring 37 may be manually pulled taut and tied to one another to cinch the throat of the ballet pointe shoe to foot 41 of the ballet dancer.

The outer fabric 6 and inner liner 7 may be made of any one or more suitable natural and/or synthetic materials. Outer fabric 6 and inner liner 7 each may have one or more layers. In some embodiments, the outer fabric 6 may be a fabric of silk satin and/or a synthetic satin or a fabric having an exterior face of a satin. In some embodiments, the outer fabric 6 may consist of, or may include, one or more layers of a fabric such as canvas or twill. The inner liner 7 in some embodiments may consist of, or may include, one or more layers of a woven or nonwoven fabric and/or a natural or synthetic leather or suede.

Insole 32 may be formed of one or more layers of any suitable material or materials. In some embodiments insole 34 may include, or optionally be formed entirely of, more layers 11 of leather, suede, foam, fabric or any other one or more other suitable natural and/or synthetic material or combination of materials. The insole 32 may optionally include, or be formed entirely of, one or more layers 10 of resilient foam and/or other cushioning material to provide improved comfort and cushion the foot 41 of a ballet dancer against impact forces. In some embodiments, layer 11 may be a top layer of the insole 32 and may consist of, or be faced with, a natural or simulated leather or suede. The top layer 11 of some embodiments may be of a material of the same type as the inner liner 7 or of a material which substantially visually matches or complements, the color and/or surface finish of the inner liner 7. In some embodiments, a layer 10 of resilient foam and/or other cushioning materials may underlie layer 10 and the layers 10 and 11 of insole 32 may optionally be bonded to one another.

The outsole 34 may be formed of one or more layers of any suitable material or materials. In some embodiments, outsole 34 is made of one or more layers of a natural or synthetic leather or suede material. Outsole 34 may be joined to the upper 22 by adhesive bonding, solvent bonding, thermal fusion bonding, ultrasonic welding, stitching or any other manner suitable for the materials used. The outsole 34 in some embodiments may optionally be an outsole of a type commonly referred to in the art as a "split sole" which has a forefoot section and a heel section which are not directly connected to one another.

Figure 4A:
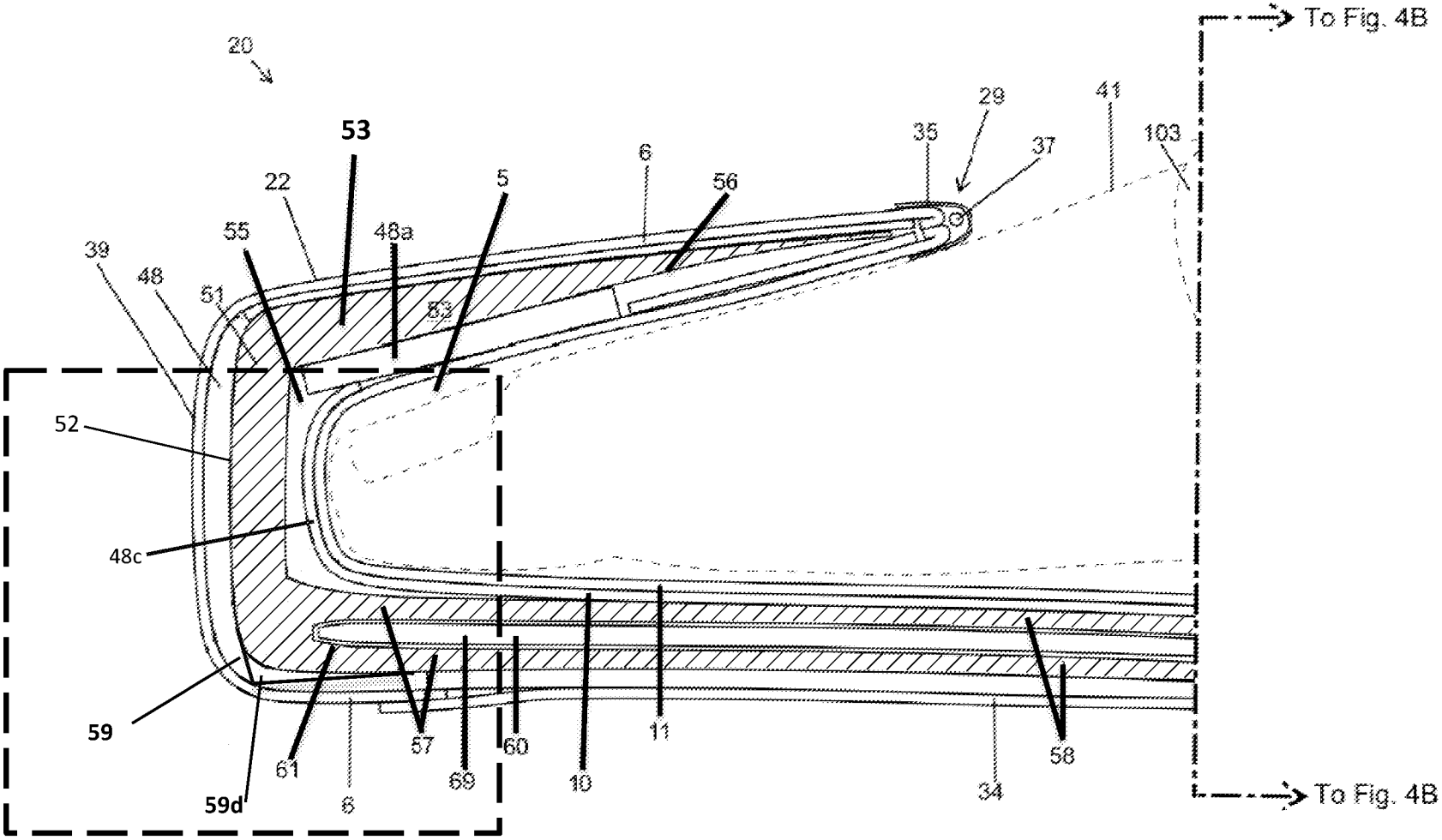
Figure 5:
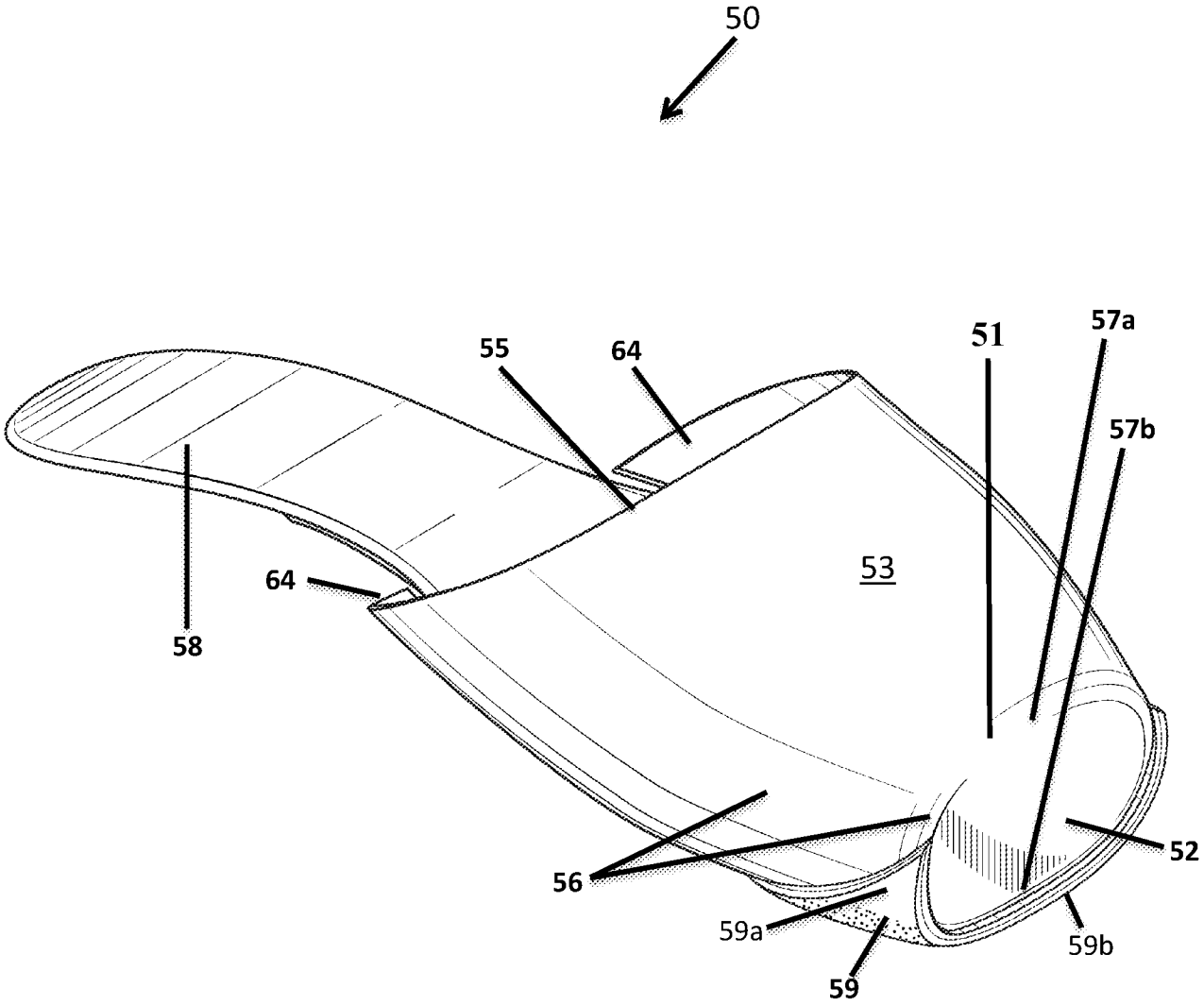
FIG. 5 is a perspective view of a monolithic foot-supporting structure having a toe box further showing an example of a malleable bumper formed on a toe box of the monolithic foot-supporting structure in accordance with the embodiments.

Referring additionally now to FIG. 5, the upper 22 of a ballet pointe shoe 20 may include a monolithic foot-supporting structure 50. The monolithic foot-supporting structure 50 includes a toe box 53 having a base 57 and a shank body 58 which extends in a rearward longitudinal direction 62*b* from the base 57 of the toe box 53. The toe box 53 may also include a peripheral wall 56. The peripheral wall 56 may adjoin the base 57 and the peripheral wall 56 and base 57 may form a cavity 55 within which at least a forefoot portion of the foot 41 the ballet dancer may be received during use of the ballet pointe shoe 20. In some embodiments the peripheral wall 56 of the toe box 53 may optionally be completely penetrated by one or more vent openings (not shown) to provide improved ventilation of body heat and moisture and more rapid evaporation of perspiration. In some embodiments, the monolithic foot-supporting structure 50 of ballet pointe shoe 20 may optionally include a pair of gussets 64 which may extend from each lateral side of the toe box 53 to or toward an adjacent side of the shank body 58. In some embodiments, optional gussets 64 may be contiguous with the peripheral wall 56 of the toe box 53. The peripheral wall 56 of toe box 53 may also include a suitably structurally supportive front wall 51 having an outer surface 52 as also shown in FIG. 4A. In some embodiments, the outer surface 52 may be substantially planar and front wall 51 may be disposed behind the platform 39 to provide mechanical support for the platform 39 as is the case in the embodiment illustrated in FIG. 4A. Alternatively, the front wall 51 in some embodiments may itself form all or part of the platform 39.

As can be seen for example in FIG. 4A, a monolithic foot-supporting structure 50 in some embodiments may optionally be provided with one or more interior and/or exterior cushioning layers 48 of foam, felt or other cushioning material. In some embodiments a cushioning layer 48 may be overlie all or at least substantial portion of the exterior surface 52 of front wall 51 of the toe box 53 at a location interposed longitudinally between the portion of the outer fabric which covers the platform 39. In addition to cushioning against impact forces during use of ballet pointe shoe 20, a cushioning layer 48 in the location just described also functions as sound-deadening which helps to soften the sound of the platform 39 impacting the floor of a stage or dance studio. In lieu of, or in addition to, the cushioning layer 48 just mentioned, some embodiments may include a second cushioning layer 48*a* at one or more locations between the interior of the toe box 53 wall 56 of cavity 55 and the toes and/or other portions of the foot 41 of a ballet dancer for improved comfort and absorption of impact forces. In some embodiments a third cushioning layer 48*c* may be interposed between the inner liner 7 and the interior of the front wall 51 of the toe box 53. In some embodiments, such cushioning layer 48*c* may be an extension of cushioning layer 48*a* and/or an extension of a cushioning layer 10 of the insole 32. In some embodiments, a cushioning layer 48*a*, 48*b* 48*c* and/or 10 may be interposed between the inner liner 7 and a substantial portion, or all, of the interior cavity 55 of the toe box 53.

As can be seen in FIGS. 4A and 5-8, the ballet pointe shoe further includes a malleable bumper 59 formed on the bottom portion 57*b* of the toe box 53 and optionally on the peripheral wall 56 of the toe box 53. The malleable bumper 59 can include a portion 59*a* that covers a portion of the peripheral wall 56 and another portion 59*b* that covers at least a portion of the bottom portion 57*b* of the toe box 53.

Figure 6:
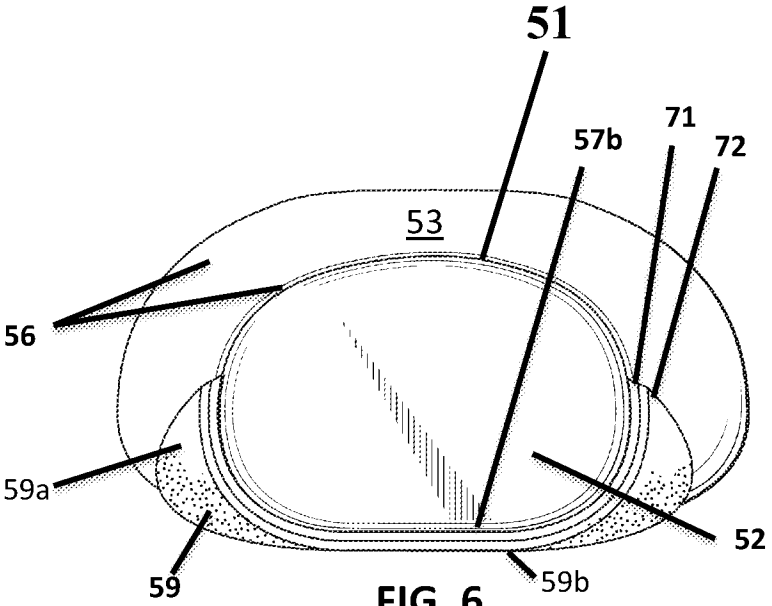
FIG. 6 is a front view of the monolithic foot-supporting structure of FIG. 5 further showing an example of a malleable bumper having multiple layers of material in accordance with the embodiments.
Figure 7:
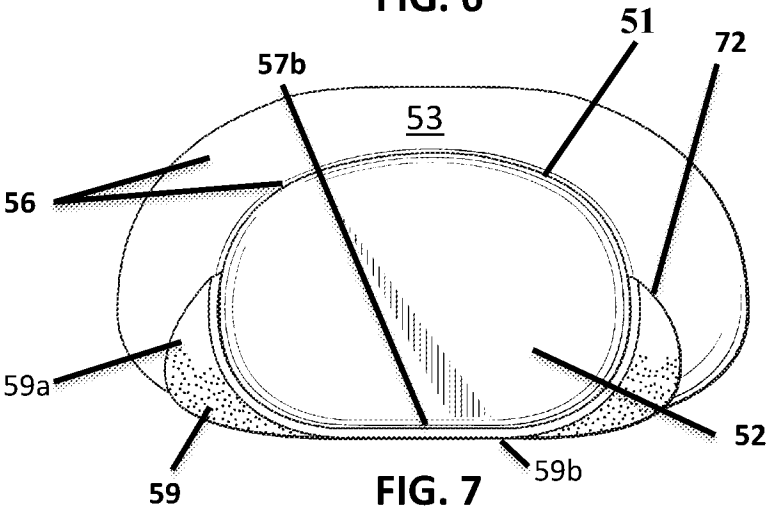
FIG. 7 is a front view of the monolithic foot-supporting structure of FIG. 5 further showing an example of a malleable bumper having a single layer of material in an initial state in accordance with the embodiments.

In some embodiments, the toe box 53 is made of thermoplastic while the malleable bumper 59 is made of a non-elastic, non-resilient material. In some embodiments the malleable bumper 59 can be made of a single layer 72 of material as shown in FIG. 7 or multiple layers such as layers 71 and 72 of FIG. 6. The one or more layers (71 and/or 72 or others) can be made of cellulose impregnated with latex such as the material known as Texon® made by Texon Materials, Inc. of Westfield Mass. In some embodiments, the material can be Texon® T516 material that contains 38% recycled content. The embodiments are not limited to Texon®, but can be made of any material having a malleable property that is non-elastic and non-resilient. In other words, once the material deforms under conditions of normal use of the ballet pointe shoe or otherwise, it does not return to its original condition. In some embodiments the toe box 53 is made of thermoplastic and the malleable bumper 59 is made of at least one or more layers of cellulose impregnated with latex. In some embodiments each layer (71, 72, etc.) of the one or more layers of cellulose impregnated with latex each has a thickness ranging from 70 millimeters to 2 millimeters. Once constructed, the single layer or the multiple layers should generally be thick enough to allow the non-elastic deformation of the portions 59*a* and 59*b* of the malleable bumper 59.

Figure 8:
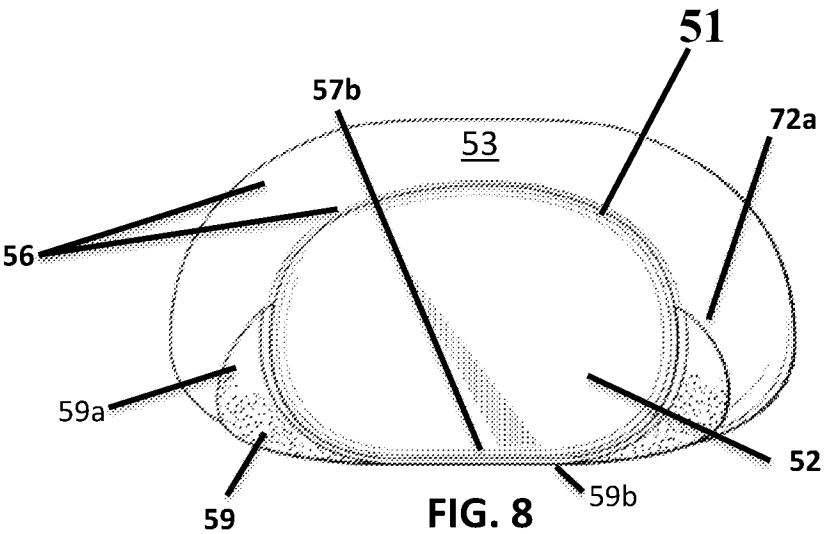
FIG. 8 is a front view of the monolithic foot-supporting structure of FIG. 7 further showing an example of the malleable bumper in a state after the malleable bumper has been partially reshaped by impact forces encountered during normal use for a period of time.

Since most platforms or toe boxes are made of a hard material such as thermoplastic, many ballerinas purposely attempt to deform existing thermoplastic platforms and their various edges to obtain a better fit and positioning before even initially wearing their ballet pointe shoes. The existing thermoplastic will deform with much effort and force, but this could occur at the expense and risk of injury to both the ballerina and ballet pointe shoe. A malleable bumper such as malleable bumper 59 enables the ballerina to tailor the deformity of the ballet pointe shoe with less effort and less risk of injury to both foot and shoe. FIG. 6 illustrates a malleable bumper 59 having multiple layers 71 and 72 formed on the toe box 53 while FIGS. 7 and 8 illustrate a malleable bumper 59 having a single layer 72 or 72*a* on the toe box 53. More particularly, FIG. 7 illustrates the single layer 72 before use and before any deformation whereas FIG. 8 illustrates the single layer 72*a* (same as layer 72, but after deformation) after the layer 72 of the malleable bumper 59 has been compressed or otherwise deformed. This deformation can occur purposely by the ballet dancer before an initial use of the ballet pointe shoe or the deformation can occur as a result of normal use of the ballet pointe shoe over time.

FIG. 4A1 and FIG. 4A2 are expanded views of a portion (represented by the dashed box in FIG. 4A) of the ballet pointe shoe which further demonstrates the deformation of the malleable bumper 59 over time. More particularly, FIG. 4A1 illustrates the malleable bumper 59 in an initial state or a less deformed state whereas FIG. 4A2 illustrates the malleable bumper 59 in a subsequent state or further deformed state. Note that in FIG. 4A1, the malleable bumper 59 has an edge 59*d* that is defined, but the edge 59*d* becomes less defined and more deformed over time as represented by the edge 59*d* shown in FIG. 4A2. Besides the edge 59*d*, the remaining surface of the malleable bumper 59 also becomes further compressed or deformed over time from normal use.

In some embodiments the malleable bumper 59 is arranged and configured to extend beyond the vertical exterior surface 52 of the bottom portion 57*b* of the toe box 53. The outer surface 52 is a vertical outer surface of the front wall 51 of the toe box 53. In some embodiments, the toe box 53 further includes a peripheral wall 56 and the malleable bumper 59 is arranged and configured to form on both a portion 59*b* on the bottom portion 57*b* of the toe box 53 and a portion 59*a* on the peripheral wall 56 of the toe box 53. In some embodiments the toe box 53 is made of thermoplastic, the malleable bumper 59 is made of at least one or more layers of cellulose impregnated with latex, and the toe box 53 further includes a peripheral wall 56 where the malleable bumper 59 is arranged and configured to form on both the bottom portion 57*b* of the toe box 53 and a portion of the peripheral wall 56 of the toe box 53.

In some embodiments, the malleable bumper 59 is made of at least one or more layers of cellulose impregnated with latex and further formed on the bottom portion 57*b* of the toe box 53 using one or more of adhesive bonding, solvent bonding, thermal fusion bonding, ultrasonic welding, or stitching. In yet other embodiments, the toe box 53 and the malleable bumper 59 can be made using double-shot molding where the toe box 53 is made of a plastic of a higher Shore durometer than the plastic used for the malleable bumper 59. In other embodiments, the toe box 53 and the malleable bumper 59 are made using thermoplastic for the toe box 53 and further overmolding a second plastic over the toe box 53 wherein the second plastic is of a lower Shore durometer than the thermoplastic and the second plastic is a non-elastic or a non-resilient material. Double shot molding, sometimes referred to as two-shot molding, co-injection molding or co-molding, is a manufacturing process used to produce complicated molded parts from two different materials by molding plastic around a preformed metal or plastic insert. Overmolding is a process of adding an additional layer of material over an already existing piece or part. In either case, the plastic or material used for the malleable bumper 59 should be "malleable" as in non-resilient and non-elastic. More specifically, the malleable material can be partially elastic or partially resilient, but not fully elastic or fully resilient.

In some embodiments the ballet pointe shoe 20 can include an upper 22 which includes a monolithic foot-supporting structure 50, where the monolithic foot-supporting structure 50 includes a toe box 53 having a peripheral wall 56 and a base 57 adjoining the peripheral wall 56 as part of a toe box 53, the toe box 53 including a bottom portion 57*a* and a top portion 57*a*. The ballet pointe shoe 20 further includes a malleable bumper 59 formed on or attached to at least the bottom portion 57*b* of the toe box 53.

Figure 4B:
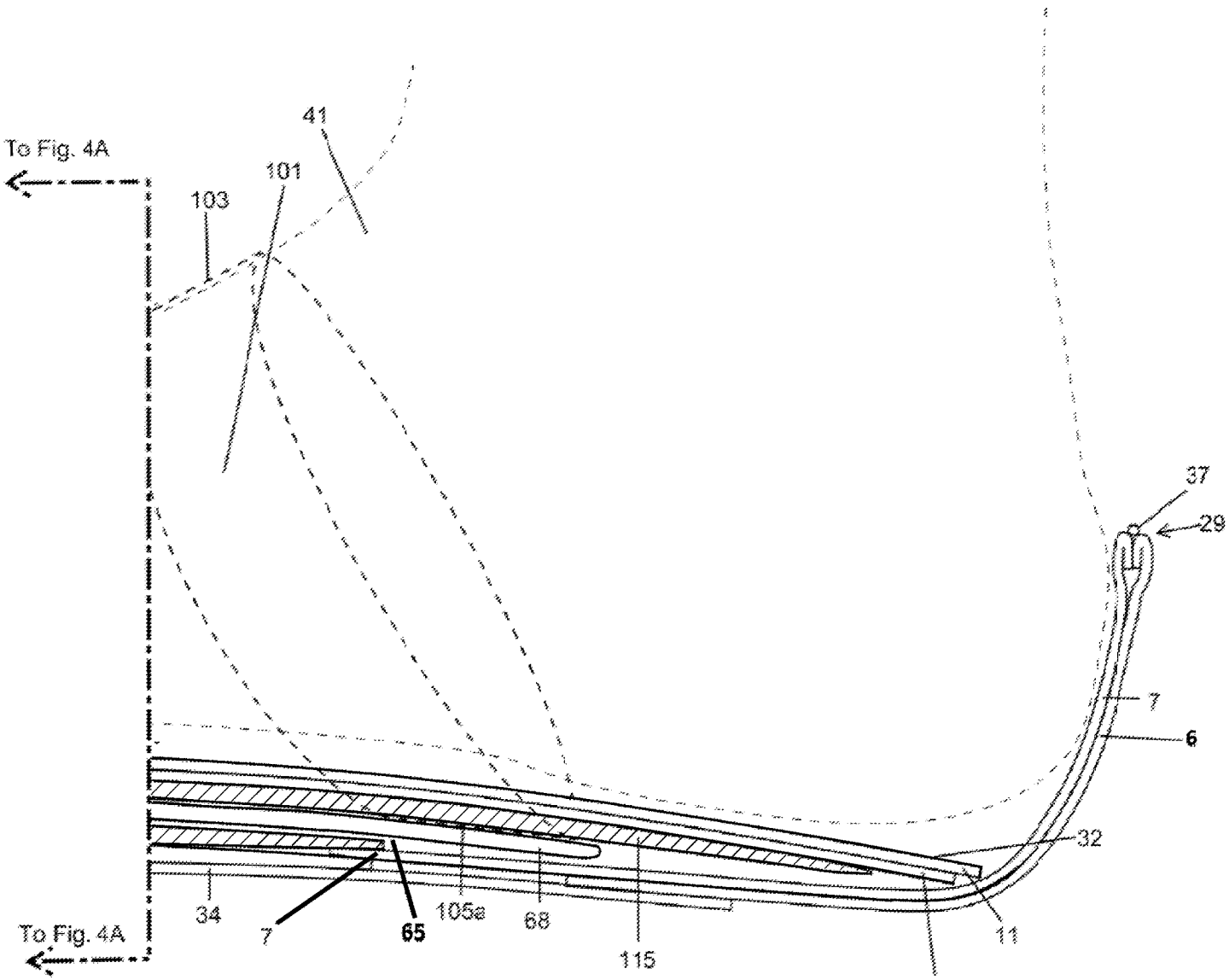
FIG. 4B is a second partial sectional view taken along line A-A of FIG. 2 with foot of a ballet dancer and an optional elastic shown in phantom lines.

In some embodiments, the upper 22 further includes a shank body 58 having a tunnel 61 which extends longitudinally through at least a portion of the shank body 58 where the tunnel 61 has a mouth 65 disposed on the shank body 58 and the mouth 65 being accessible by way of the foot compartment without deconstructing the ballet pointe shoe even partially as illustrated in FIGS. 4A and 4B. In some arrangements, the ballet pointe shoe 20 further includes a shank insert 60, at least a forward portion of the shank insert 60 being removable and replaceably received in the tunnel 61 when the shank insert 60 is installed in the tunnel 61, the shank insert 60 being removable from the ballet pointe shoe 20 by withdrawing the forward portion of the shank insert 60 from the tunnel 61 by way of the mouth 65. In some arrangements, the shank insert 60 is selected from a set of two or more of the shank inserts 60, at least one shank insert 60 in the set having a first flexural rigidity profile, at least one other shank insert 60 in the set having a second flexural rigidity profile which differs from the first flexural rigidity profile.

In some embodiments, the toe box 20 is made of thermoplastic and the malleable bumper 59 is made of a single layer 72 of cellulose impregnated with latex. In other arrangements, the toe box 20 is formed of a thermoplastic material and the malleable bumper 59 is made of two or more layers (71, 72, etc.) of cellulose impregnated with a binder material such as latex enabling the malleable bumper 59 to reshape as a means of further form fitting the shoe before initial use or for form fitting over time from use.

In some embodiments, a ballet pointe shoe 20 for use by a ballet dancer can include an upper 22 which includes a monolithic foot-supporting structure 50 made of thermoplastic, where the monolithic foot-supporting structure 50 includes a toe box 53 having a peripheral wall 56 and a base 57 adjoining the peripheral wall 56. The ballet pointe shoe 20 can further include a malleable bumper 59 formed on a portion (represented by the bottom portion 57*b* of the toe box 53) of the base 57 and on a portion of the peripheral wall 56.

As used herein to describe a structure, such as monolithic foot-supporting structure 50, the term "monolithic" refers to a structure formed as a single unit. As the term is used herein, a "monolithic" structure can permissibly be homogeneous but is not required to be homogeneous. A "monolithic" structure may be formed of one material or more than one material. A structure which is formed by casting, injection molding or other molding process is "monolithic" even if it includes one or more molded-in, or cast-in parts which were separate before being incorporated in the molded or cast structure. A "monolithic" structure may permissibly include, but is not required to include, one or more fillers, additives and/or reinforcements or other materials.

In some embodiments all, or at least a portion, of a monolithic foot-supporting structure 50 may be formed of a thermoplastic material. In some embodiments the thermoplastic material may be a thermoplastic elastomer such as thermoplastic polyurethane (TPU) or a thermoplastic polyurethane (TPU) blend. Such a monolithic foot-supporting structure 50 can be made for example by injection molding the shank body 58 and the toe box, including its peripheral wall 56, base 57 and if present, optionally gussets 64, as a unitary molded member. A non-limiting example of one of many suitable thermoplastic materials is a thermoplastic polyurethane which is commercially available under the product name Prismathane® HPU 780A from Prisma Montelur Compostos Termoplastos of Campo Bom, Brazil. In some embodiments, the bottom of the shank body 58 and/or the toe box 53 may optionally include one or more holes 70. Holes 70 may be thru-holes and/or blind holes and may serve to reduce the amount of material required to manufacture monolithic foot-supporting structure 50, reduce its weight and/or to facilitate its manufacture by an injection molding process.

In some embodiments, the monolithic foot-supporting structure 50 may include a longitudinal tunnel 61 within which an optional shank insert 60 may be removably and replaceably installed. In some embodiments, the tunnel 61 extends longitudinally through at least a portion of the shank body 58. In certain embodiments, the tunnel 61 extends longitudinally through all, or at least a portion of, the shank body 58 and into at least a portion of the base 57 of the toe box 53 as shown for example in FIGS. 4A and 4B wherein a shank insert 60 shown installed in the tunnel 61. When a shank insert 60 is in an installed state, at least a forward portion 69 of the shank insert 60 is removably and replaceably received in the tunnel 60. In some embodiments, and/or modes of use, an installed shank insert 60 longitudinally spans all or substantially all of the tunnel 61, including without limitation, any portion of the tunnel 61 which extends into the base 57 of the toe box 53. In some other embodiments and/or other modes of use, a shank insert 60 may span only a portion of the longitudinal span of the tunnel 61. It will be understood that even when installed, a shank insert 60 is not itself a part of the monolithic foot-supporting structure 50. A ballet pointe shoe 20, may be used either with or without a shank insert 60 installed therein.

In some embodiments, the tunnel 61 has a mouth 65 disposed on the shank body 58 and the mouth 65 of the tunnel 61 is functionally accessible way of the foot compartment 5 to permit insertion and removal for shank insert 60 by way of the foot compartment 5 without using tools and/or even partially deconstructing the ballet pointe shoe 20.

A shank insert 60 is removable from some embodiments of a ballet pointe shoe 20 by withdrawing the shank insert 60 from the tunnel 61 by way of the mouth 65. In some embodiments, a shank insert 60 can be withdrawn in a longitudinally rearward direction 62*b* relative to the mouth 65 of the tunnel 61. A shank insert 60 can be installed, or can be replaced with either the same shank insert 60 or a different one, by inserting the shank insert 60 into the tunnel 61 by way of the mouth 65. In some embodiments, a shank insert 60 can be installed or replaced by inserting it into the tunnel 61 in a longitudinally forward direction 62*a* relative to the mouth 65 of the tunnel 61.

While in some embodiments a shank insert 60 may be substantially uniform cross-sectional size and shape over its length, L, such is not essential. It is to be understood that the flexural rigidity profile of a shank insert 60 is not determined solely by the material or materials of which it is made but is also dependent on shape and dimensional factors. Thus, a desired flexural rigidity profile may be achieved, at least in part, reshaping a shank insert 60 at one or more longitudinal positions or regions along its length L.

In certain embodiments, the support characteristics and/or fit of a ballet pointe shoe 20 may be customized or adjusted by reshaping one or more shank inserts 60 from a previous shape into an altered shape, and/or by re-shaping the toe box 53 of the monolithic foot-supporting member 50 from a previous shape into an altered shape and/or by re-shaping the malleable bumper 59 from a previous shape into an altered shape. By reshaping the wall 56, the effective size and shape if the inner cavity 55 can be effectively changed. Reshaping of the toe box 53 of the monolithic foot-supporting member 50, can be carried out while the monolithic foot-supporting member 50 remains in the ballet pointe shoe 20 and that not even partial deconstruction of the ballet pointe shoe 20 is required to reshape the toe box 53.

In one example of alternative mode of use a ballet pointe shoe 20 may be worn and used for ballet dancing or ballet dance training with either no shank insert 60 present at all or with an installed shank insert 60 which is highly flexible over its entire working length. In such alternative mode of use a ballet pointe shoe 20 can be used in lieu of what is commonly referred to in the art as a "demi-pointe shoe". Thus, as used herein and in the claims the term "ballet pointe shoe" is not to be construed to exclude a demi-pointe shoe.

In certain embodiments, the toe box 53 or at least a portion of the peripheral wall 56 of toe box 53 may be made of one or more thermoplastic materials of a type capable of being selectively heated and reshaped at any time after initial manufacture of the ballet pointe shoe 20 in which the monolithic foot-supporting structure 50 is incorporated. This may be achieved by carrying out the steps of: (a) heating all, or at least the portion of, the wall 56 to a softening temperature of the thermoplastic material, the softening temperature being a temperature or temperature range which is below the melting temperature of the thermoplastic material, (b) applying external force, F, to the softened material to reshape at least a portion of the interior cavity 55 of the toe box 53 into an altered shape which differs from its previous shape, and (c) lowering the temperature of the thermoplastic material to a temperature which is sufficiently below the softening temperature to permit the altered shape to be retained semi-permanently that is, retained even after the applied reshaping force, F, has been removed. Lowering the temperature can be carried out actively and/or passively. One example of a suitable thermoplastic material of which all or at least a portion of the wall 56 of toe box 53 may be made in order to facilitate selective heated and reshaping of the toe box 53 is a thermoplastic elastomer such as thermoplastic polyurethane (TPU). Similarly, if the malleable bumper 59 is made of a material of a type capable of being selectively heated and reshaped, a similar process can be done to alter the shape of malleable bumper 59.

In some embodiments, the method of reshaping toe box 53 may optionally comprise step of reshaping the toe box 53 into a subsequent altered shape after the steps (a) through (c) described in the paragraph immediately above have been carried out. Such optional step may, in some embodiments, comprise the substeps of: (i) re-heating all, or at least the portion of, the wall 56 to a softening temperature of the thermoplastic material, (ii) applying external force, F, to the softened thermoplastic material to reshape at least a portion of the interior cavity 55 of the toe box 53 into a subsequent altered shape, and (iii) lowering the temperature of the thermoplastic material to a temperature which is sufficiently below the softening temperature to permit the subsequent altered shape to be retained semi-permanently. The optional step of reshaping the toe box 53 into a subsequent altered shape can, if desired, be repeated one or more times as the needs and/or preferences of a ballet dancer dictate by repeating the substeps (i) through (iii) just described.

Heat for softening the thermoplastic material of the toe box 53 may be generated and applied in any suitable manner such as by forced hot air heating using a hair dryer or heat gun, heating in an a conventional oven, convection oven, microwave heating, infrared heating or immersion in hot water or other hot liquid.

Reshaping of the interior cavity 55 of a toe box 53 herein can be carried out at any time or place after initial manufacture such as at a point of sale or even at a point of use of a monolithic foot-supporting structure 50 and/or a ballet pointe shoe 20. Reshaping of the interior cavity 55 of toe box 53 affords not only a better fitting and more comfortable ballet pointe shoe 20 but also makes it possible to provide properly fitting ballet pointe shoe 20 for different dancers without need to manufacture, ship and/or inventory as many different sizes and/or shapes of ballet pointe shoe 20 as would otherwise be required. Also, the reshaping of interior cavity 55 can be carried out at any time or place after initial manufacture such as at a point of sale or even at a point of use in order to adjust customize the ballet pointe shoe 20 to suit the needs or preferences of a particular dancer.

Moreover, reshaping of the interior cavity 55 wall 56 of toe box 53 or the malleable bumper 59 as described herein can be carried out repeatedly as many times as may be desired over the useful of the monolithic foot-supporting structure 50 and/or a ballet pointe shoe 20 in order to suit the needs or preferences of a particular dancer at any given point in time. Such needs and preferences, can change from time to time for a variety of reasons. For example, a ballet pointe shoe 20 of a young dancer may be reshaped one or more times to accommodate changes in the size and/or shape of the foot due to growth of the dancer as the dancer grows. Reshaping of the interior cavity 55 of toe box 53 may also be carried out to accommodate temporary or permanent changes in the size and/or shape of the of foot 41 a dancer due to swelling or injury. For instance, a dancer whose foot may swell or develop a blister or other tender area may desire to reshape the interior cavity 55 of toe box 53 to relieve pressure on the affected area. Conversely, a particular injury or condition of the foot 41 of a dancer may benefit by reshaping of the interior cavity 55 of toe box 53 to provide increased pressure or support for the foot 41 at one or more areas within cavity 55. Once the foot injury or condition is resolved, the monolithic foot-supporting structure 50 and/or the ballet pointe shoe 20 in which the monolithic foot-supporting structure 50 is incorporated may optionally be reshaped yet again to restore the interior cavity 55 of the toe box 53 to a prior shape or to reshape it into a new subsequent altered shape which may differ from any prior shape.

Some embodiments of a ballet pointe shoe 20 may include an optional elastic loop 101. An elastic loop 101 be formed in part or entirely of an elastic band 99 and which may at least partially surround or overlap a portion of the foot 41 of a dancer during use. In some embodiments, elastic loop 101 may be formed of a single piece of material. In other embodiments elastic loop 101 may be formed of two or more pieces of material which may be joined to one another to form all or part of elastic loop 101. An elastic loop 101 may be removably and replaceably mounted at an arch or midfoot portion of the ballet pointe shoe 20 in such a way that in use, the loop 101 may continuously exert an elastic force which continuously urges the shank body 58 and an insole 32 if one is present, toward the sole of the foot 41 of the dancer. In some embodiments the midsole may comprise or include a shank body 58 and/or a shank insert 60. In some embodiments, the elastic loop 101 may be mounted within the upper 22 such that during use, an upper portion 103 of the loop 101 may also overlap an instep portion of the foot 41 such that in use, the upper portion 103 of the elastic loop 101 continuously applies an elastic compressive force between an instep portion of a foot of a dancer and the shank body 58. This continuously urges the shank body 58, and the insole 32 if one is present, to bear forcibly toward the sole of the foot, even at times the dancer might be airborne. In some embodiments, the lower portions 105*a*, 105*b* of the elastic loop 101 may be located at a position in the longitudinal direction 62 which preferably lies within a range of longitudinal positions extending along at least a portion of the longitudinal span of the arch of the foot 41 of the dancer. The elastic loop 101 may include side portions 106 each of which may extend between upper portion 103 and a respective one of the lower portions 105*a* and 105*b*.

In some embodiments and/or modes of use, an elastic loop 101 may be mounted by releaseably capturing a portion of elastic loop 101 between two structures lying beneath the insole 32. An example is illustrated in FIG. 4B. There, a lower portion 105*a* of the elastic loop 101 is routed beneath the shank body 58, in this example beneath the ledge 115 of the shank body 58, while the upper portion 103 of the elastic loop 101 is routed over the instep of the foot 41. In FIG. 4B a shank insert 60 is installed and has a rear portion 68 that extends longitudinally rearward of the mouth 65 of the tunnel 61 in which the forward portion 69 of the shank insert 60 is received. The lower portion 105*a* of the elastic loop 101 is releaseably captured between the ledge 115 the rear portion 68 of the of the shank insert 60. In use, the weight exerted by a foot of dancer and the elastic force exerted by the elastic loop 101 clamps the elastic loop 101 in place without requiring the elastic loop 101 to be glued, sewn, welded, stapled, riveted or otherwise permanently fastened to the ballet pointe shoe 20 at a particular longitudinal position. The elastic loop 101 can at any time be easily repositioned longitudinally relative to shank body 58 by removing the shoe from the foot 41 and manually adjusting its longitudinal position relative to shank body 58. The elastic loop 101 is not only longitudinally repositionable but is also removable and/or replaceable with another elastic loop 101.

While some embodiments of a ballet pointe shoe 20 may be used during ballet performances and/or during ballet training with or without an elastic loop 101 installed, a ballet pointe shoe 20 having an elastic loop 101 installed is particularly useful during ballet training as the pressure exerted by the elastic loop 101 on the foot of the dancer provides tactile feedback which can assist the dancer in sensing that their foot 41 is properly centered within the toe box 53.

In interpreting the present disclosure and the claims, references of the form "A and/or B" encompass any and every combination and subcombination of elements A and B, namely, any or all of the following: (i.) A, (ii.) B, (iii.) A or B, and (iv.) A and B. References of the form "A, B, and/or C" likewise encompass any and every combination and subcombination of elements A, B and C). Where the present disclosure or any of the claims may recite "a" or "a first" item or the equivalent thereof, such disclosure includes one or more such items and does not require or exclude two or more such items. Numerical or ordinal terms such as "first", "second", "third" etc. when used to refer to items are used solely to identify the items, and do not require or limit the number of such items elements and do not indicate, require or limit a particular position or order of such items unless expressly and clearly stated otherwise.

Descriptions made with reference to "embodiment", "embodiments", "some embodiments", "an embodiment", "preferred embodiment". "other embodiments" "alternative embodiments", "various embodiments" or the like mean that the description is applicable to at least one embodiment of the invention but not necessarily all embodiments. The terms "comprising," "including," "having," and the like, as used with respect to one or more embodiments, are synonymous. In some cases features, items steps or other subject matter are described herein as being optional or using terms such as "optional" or "optionally". However, lack use of such terms in connection with the description of any other features, items steps or other subject matter does not in any way mean or imply that such other features, items steps or other subject matter are required or are not optional.

As an aid to understanding, various actions, operations or steps may sometimes be presented herein or described herein in sequence. However, the order of description or written presentation herein is not to be construed to mean or imply that such must necessarily occur in a corresponding order or sequence unless otherwise expressly and clearly stated or logically essential. Some actions, operations or steps may permissibly be performed in an order or sequence other than the order of their description or written presentation herein unless otherwise expressly and clearly stated or logically essential. Unless otherwise expressly and clearly stated or logically essential, actions, operations or steps described herein may be combined or divided. Unless otherwise expressly and clearly stated or logically essential, any description herein of any one or more actions, operations or steps does not preclude any one or more other preceding, succeeding and/or intervening actions, operations or steps irrespective of whether or not such preceding, succeeding and/or intervening actions, operations or steps are described or disclosed herein.

Unless otherwise expressly and clearly stated or logically essential, any illustration, description, or reference herein of any one or more items, structures or elements being "connected to", "coupled to", "joined to", "joined with", "attached to", "mounted to", "mounted in" or "secured to" any one or more other specified items, structures or elements shall not be construed to preclude such connection, coupling, joint, attachment, mounting or securement being either made indirectly, by way of one or more other specified or unspecified items structures or elements, or being made directly.

Unless otherwise expressly and clearly stated or logically essential, any illustration, description, or reference herein of any one or more items, structures or elements "adjoining", any one or more other specified items, structures or elements, shall be construed to permit that such may adjoin either direct or indirectly. The term "adjoining" permits, but does not require, preclude the presence of items, structures or elements interposed between those describes as adjoining. Unless otherwise expressly and clearly stated or logically essential, any illustration, description, or reference herein to any one or more items, structures or elements being "beneath", "below", "above", "behind", "in front of", "between", "under", "over", "in", "within", "outside", "inside" any one or more other specified items, structures or elements and/or any other prepositions or prepositional phrases shall construed in a manner which permits, but does not require, contact or immediacy and any and all other prepositions and/or prepositional phrases shall be construed in that same manner.

As used herein, the term "material" encompasses, without limitation, unblended materials having a single constituent, blended materials having two or more constituents, composite materials, homogeneous materials and non-homogeneous materials.

While the invention has been described with reference to various preferred embodiments, it will be understood by those skilled in the art that various changes may be made and equivalents substituted for elements thereof without departing from the scope of the invention and that modifications may be made to adapt to a particular situation or application of the invention without departing from the scope of the invention. The invention is not limited to the particular embodiments disclosed. Rather, the invention covers all embodiments which are within the scope of the claims, either literally or under the Doctrine of Equivalents.

What is claimed is:

1. A ballet pointe shoe for use by a ballet dancer, the ballet pointe shoe, comprising:

(a) an upper having a foot compartment, a toe box and a platform, the platform being located at a front end of upper, the toe box having a base and a peripheral wall which adjoins the base, the peripheral wall including a front wall, the front wall having a vertical outer surface which is located behind the platform in a longitudinally rearward direction;

(b) an insole disposed within the upper at the bottom of the foot compartment;

(c) an outsole secured to the upper; and wherein the upper further includes a non-elastic and non-resilient malleable bumper attached to the toe box, the entire malleable bumper being located behind the platform in the longitudinally rearward direction, at least a portion of the malleable bumper being located on a portion of the base which is longitudinally rearward of the platform and beneath the front wall of the toe box.

2. A ballet pointe shoe as claimed in claim 1, wherein the malleable bumper lies flush with the vertical outer surface of the front wall.

3. A ballet pointe shoe as claimed in claim 1, wherein the malleable bumper is-made of at least one layer of cellulose impregnated with latex and wherein the malleable bumper is attached to the toe box using one or more of adhesive bonding, solvent bonding, thermal fusion bonding, ultrasonic welding and stitching.

4. A ballet pointe shoe as claimed in claim 1, wherein the platform and the malleable bumper are made using double-shot molding wherein the platform is made of a plastic of a higher Shore durometer than the plastic used for the malleable bumper.

5. The ballet pointe shoe as claimed in claim 1, wherein the platform and the malleable bumper are made using thermoplastic for the platform and further overmolding a second plastic over the platform wherein the second plastic is of a lower Shore durometer than the thermoplastic and the second plastic is a non-elastic and non-resilient material.

6. A ballet pointe shoe as claimed in claim 4, wherein the toe box is made of thermoplastic and the malleable bumper is made of a single layer of cellulose impregnated with a binder or made of two or more layers of cellulose impregnated with the binder.

* * * * *